US008201584B2

(12) United States Patent
Ito et al.

(10) Patent No.: US 8,201,584 B2
(45) Date of Patent: Jun. 19, 2012

(54) EXHAUST PIPE

(75) Inventors: Yasutaka Ito, Ibi-gun (JP); Jin Wakamatsu, Toyota (JP)

(73) Assignees: Ibiden Co., Ltd., Ogaki-shi (JP); Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 12/516,374

(22) PCT Filed: Jun. 19, 2008

(86) PCT No.: PCT/JP2008/061266

§ 371 (c)(1),
(2), (4) Date: Sep. 15, 2010

(87) PCT Pub. No.: WO2009/069333

PCT Pub. Date: Jun. 4, 2009

(65) Prior Publication Data

US 2011/0000575 A1 Jan. 6, 2011

(30) Foreign Application Priority Data

Nov. 28, 2007 (JP) ..... 2007-307946

(51) Int. Cl.
*F16L 9/14* (2006.01)

(52) U.S. Cl. ..... 138/143; 138/146

(58) Field of Classification Search ..... 138/146, 138/143

See application file for complete search history.

(56) References Cited

U.S. PATENT DOCUMENTS 2,209,304 A 7/1940 Alder
3,233,697 A * 2/1966 Games Slayter et al. ..... 181/245
3,488,723 A 1/1970 Veazie
6,833,553 B2 * 12/2004 Slingo ..... 250/504 R
2003/0113248 A1 * 6/2003 Mohr et al. ..... 423/213.2
2004/0241443 A1 * 12/2004 Decker et al. ..... 428/402
2006/0086077 A1 4/2006 Skoog et al.

(Continued)

FOREIGN PATENT DOCUMENTS

CN 1380489 11/2002

(Continued)

OTHER PUBLICATIONS

Anonymous, "Insulation Fundamentals: Emissivity", Insulation Outlook, Jul. 1, 2000, XP002604937.

(Continued)

*Primary Examiner* — James Hook
(74) *Attorney, Agent, or Firm* — Ditthavong Moir & Steiner, P.C.

(57) ABSTRACT

An object of the present invention is to provide an exhaust pipe that can lower the temperature of exhaust gases when the exhaust gases having a high temperature pass through the exhaust pipe. The exhaust pipe of the present invention, which allows exhaust gases to flow through the exhaust pipe, comprises a base that contains metal and has a cylindrical shape; and a surface-coating layer that contains a plurality of crystalline inorganic materials and an amorphous binder and is formed on the outer peripheral face of the base, wherein the plurality of crystalline inorganic materials are distributed in the surface-coating layer, in an accumulative manner in a thickness direction, and the amorphous binder has an average thickness of 20 μm or less at a location nearer the outer peripheral face of the exhaust pipe than a location of the crystalline inorganic materials.

2 Claims, 4 Drawing Sheets

U.S. PATENT DOCUMENTS

| | | | | |
|---|---|---|---|---|
| 2007/0224431 | A1 * | 9/2007 | Decker et al. | 428/447 |
| 2009/0017283 | A1 * | 1/2009 | Hiramatsu et al. | 428/304.4 |

FOREIGN PATENT DOCUMENTS

| | | |
|---|---|---|
| JP | 59-12116 | 1/1984 |
| JP | 4-209588 | 7/1992 |
| JP | 5-47339 | 6/1993 |
| JP | 11-141304 | 5/1999 |
| JP | 2003-253475 | 9/2003 |
| JP | 2005-194962 | 7/2005 |
| JP | 2007-201346 | 8/2007 |

OTHER PUBLICATIONS

Extended European Search Report for corresponding EP Application No. 08765761.5-1215, Nov. 19, 2010.

Japanese Office Action for corresponding JP Application No. 2007-307946, Jun. 7, 2011.

* cited by examiner (a)

(b)

(a)

(b)

EXHAUST PIPE

TECHNICAL FIELD

The present invention relates to an exhaust pipe.

BACKGROUND ART

An exhaust pipe connected to a vehicle engine becomes significantly hot in driving operation because combustion gases (exhaust gases) flow inside thereof. In a high-load and high-revolution area of the engine, fuel is increased so as to avoid a rise in temperature of exhaust gases. In such a case, however, a problem is occurred that fuel efficiency is lowered and concentration of exhaust gases is raised, so that a discharge amount of contaminants is increased.

Further, when the temperature of the exhaust pipe is raised by a flow of exhaust gases, it causes heat degradation of the exhaust pipe.

Inside an exhaust pipe, a catalyst is provided for converting exhaust gases discharged from a vehicle engine. For example, a three-way catalyst can convert contaminants such as nitrogen carbide (HC), carbon monoxide (CO), and nitrogen oxide (NOx) which are contained in exhaust gases.

In order to convert these contaminants by a three-way catalyst more efficiently, it is necessary to maintain the three-way catalyst at a predetermined activation temperature.

However, in a high-speed operation of a vehicle engine, exhaust gases become very hot and there may be a case where the temperature of a three-way catalyst becomes out of the effective range for conversion of exhaust gases and fails to convert contaminants properly. Moreover, there may be a case where the three-way catalyst is thermally deteriorated due to high-temperature exhaust gases.

Accordingly, it is demanded that an exhaust pipe connected to a vehicle engine be capable of releasing the heat of exhaust gases flowing inside of the exhaust pipe in the high-speed operation of the vehicle engine.

For example, Patent Document 1 discloses an exhaust pipe of double pipe structure provided with a movable heat-transfer member between an inner pipe and an outer pipe of the double pipe. This exhaust pipe prevents exhaust gases from becoming very hot in high-speed operation of a vehicle engine, thereby satisfying the above demand for the exhaust pipe.

Patent Document 1: JP-A 2005-194962

DISCLOSURE OF THE INVENTION

Problems to be Solved by the Invention

In the exhaust pipe disclosed in Patent Document 1, the heat transfer member is provided between the inner pipe and the outer pipe to prevent exhaust gases from becoming very hot in high-speed operation of an internal combustion engine. The exhaust pipe has a disadvantage because it needs a large number of parts and results in a complex structure.

Means for Solving the Problems

The inventors of the present invention have studied hard, so as to complete an exhaust pipe based on a technical idea entirely different from the technical idea for the exhaust pipe disclosed in Patent Document 1, as an exhaust pipe satisfying the above demand for the exhaust pipe.

Namely, an exhaust pipe according to claim 1, which allows exhaust gases to flow through the exhaust pipe, includes a base that contains metal and has a cylindrical shape; and a surface-coating layer that contains a plurality of crystalline inorganic materials and an amorphous binder and is formed on the outer peripheral face of the base, wherein the plurality of crystalline inorganic materials are distributed in the surface-coating layer, in an accumulative manner in a thickness direction, and the amorphous binder has an average thickness of 20 μm or less at a location nearer the outer peripheral face of the exhaust pipe than a location of the crystalline inorganic materials.

The exhaust pipe described in claim 1 is provided with a surface-coating layer containing a plurality of crystalline inorganic materials and an amorphous binder, and thereby exhaust pipe of the present invention have an excellent heat-releasing property.

More specifically, the surface-coating layer is formed by using the plurality of crystalline inorganic materials and the amorphous binder. The crystalline inorganic materials are distributed in such a surface-coating layer in an accumulative manner in a thickness direction of the surface-coating layer. In the present invention, the crystalline inorganic materials are the ingredient that mainly contributes to the heat-releasing property of the exhaust pipe. The heat-releasing property of the exhaust pipe will be improved as a projected area of the crystalline inorganic materials, which appears when the crystalline inorganic materials are projected onto the surface of the base, becomes large. The plurality of crystalline inorganic materials distributed in the surface-coating layer in an accumulative manner in the thickness direction of the surface-coating layer are likely to enlarge the projected area of the crystalline inorganic materials on the surface of the base. Therefore, the exhaust pipe described in claim 1 has an excellent heat-releasing property.

Further, in the surface-coating layer according to the exhaust pipe described in claim 1, the amorphous binder has an average thickness of 20 μm or less at a location nearer the outer peripheral face of the exhaust pipe than a location of the crystalline inorganic materials. Heat release from the surface-coating layer mainly depends on radiation of infrared rays from the crystalline inorganic materials. Hence, the surface-coating layer has an excellent heat-releasing property due to the amorphous binder having a thin average thickness of 20 μm or less at a location nearer the outer peripheral face of the exhaust pipe than a location of the crystalline inorganic materials. As a result, the exhaust pipe described in claim 1 has an excellent heat-releasing property.

As described above, since the surface-coating layer containing the crystalline inorganic materials and the amorphous binder satisfies specific conditions, the exhaust pipe of the present invention have an excellent heat-releasing property.

In the invention described in claim 2, a heat-receiving member is arranged over the outer peripheral face of an exhaust pipe body that includes the base and the surface-coating layer.

According to the exhaust pipe described in claim 2, provision of the heat-receiving member facilitates heat transfer from the exhaust pipe body to the heat-receiving member, and thereby heat release from the exhaust pipe body more surely proceeds.

BEST MODE FOR CARRYING OUT THE INVENTION

An exhaust pipe of the present invention is described below in detail.

The exhaust pipe of the present invention includes a base that contains metal and has a cylindrical shape; and a surface-coating layer that contains a plurality of crystalline inorganic materials and an amorphous binder and is formed on the outer peripheral face of the base, wherein the plurality of crystalline inorganic materials are distributed in the surface-coating layer, in an accumulative manner in a thickness direction, and the amorphous binder has an average thickness of 20 μm or less at a location nearer the outer peripheral face of the exhaust pipe than a location of the crystalline inorganic materials.

The exhaust pipe of the present invention can be suitably used as a member for forming an exhaust system connected to an internal combustion engine of a vehicle engine and the like. More specifically, it can be suitably used in an exhaust manifold and the like. The use of the exhaust pipe of the present invention is of course not limited to this.

In the following, the exhaust pipe of the present invention will be described taking as an example an exhaust manifold to be connected to an internal combustion engine of a vehicle engine and the like.

FIG. 1(*a*) is a cross-sectional view schematically showing a vehicle engine and an exhaust system connected thereto, and FIG. 1(*b*) is an A-A line cross-sectional view of FIG. 1(*a*). It is to be noted that FIG. 1(*b*) shows an enlarged view of the A-A line cross-sectional view of FIG. 1(*a*).

As shown in FIG. 1(*a*), an exhaust manifold 11 is connected to an engine 10 and a catalyst converter 12 provided with a catalyst supporting carrier 13 is connected to the exhaust manifold 11.

Exhaust gases G discharged from the engine 10 flow into the catalyst converter 12 through the exhaust manifold 11, and then, exhaust gases G are converted by a catalyst supported on the catalyst supporting carrier 13 and are discharged from an outlet.

It is to be noted that arrows in FIG. 1(*a*) show a flow of the exhaust gases G.

As shown in FIG. 1(*b*), the exhaust manifold 11 is provided with a stainless-steel base 14 having a cylindrical shape and a surface-coating layer 15 formed on the outer peripheral face of the base 14.

Here, it is desirable that the surface-coating layer 15 have an emissivity of 0.78 or higher at a wavelength of 1.5 to 8 μm.

The above infrared emissivity is measured at 600° C., and the measurement can be performed using for example an FT-IR analyzer.

When exhaust gases having a high temperature flow into the exhaust manifold 11 shown in FIGS. 1(*a*) and 1(*b*), the high heat-releasing property of the surface-coating layer 15 can decrease the temperature of the exhaust gases.

A material of the base 14 forming the exhaust manifold 11 is not limited to stainless steel, and examples of the material of the base include, in addition to stainless steel, metals such as steel, iron and copper, and nickel-based alloys such as Inconel, Hastelloy and Invar. Since these metal materials have high thermal conductivities, the heat-releasing property of the exhaust manifold can be improved.

Further, since these metal materials have high heat-resistant properties, these can be suitably used in the high-temperature region. By using these metal materials as the base, the exhaust manifold is allowed to be excellent in resistance to thermal shock, processability and mechanical properties, and is comparatively low in price.

A shape of the base is not particularly limited as long as it is a cylindrical shape. Examples of its cross-sectional shape include a circular shape as shown in FIG. 1(*b*), and any shape such as an elliptical shape and a polygonal shape.

When the cross section of the base has a shape other than a perfect circle, contact areas with exhaust gases are larger and thus the heat radiation tends to be improved.

In the present invention, the cross-sectional shape of the exhaust pipe is substantially the same shape as the cross-sectional shape of the base.

The surface-coating layer 15 forming the exhaust manifold 11 contains crystalline inorganic materials and an amorphous binder.

In the surface-coating layer 15, the plurality of the crystalline inorganic materials are distributed in an accumulative manner in a thickness direction of the surface-coating layer 15 and the amorphous binder has an average thickness of 20 μm or less at a location nearer the outer peripheral face of the exhaust manifold 11 than a location of said crystalline inorganic materials.

Now, the surface-coating layer 15 is described in detail with reference to the drawings.

FIG. 2(*a*) is a partially enlarged B-B line cross-sectional view of the exhaust pipe (exhaust manifold) 11 shown in FIG. 1(*b*). FIG. 2(*b*) is an enlarged view of a region C in FIG. 2(*a*).

The surface-coating layer 15 formed on the outer peripheral face of the base 14 contains crystalline inorganic materials 151 and an amorphous binder 152, and the crystalline inorganic materials 151 are dispersed in the amorphous binder 152. The amorphous binder 152 has an average thickness of 20 μm or less at a location nearer the outer peripheral face of the exhaust pipe than a location of the crystalline inorganic materials 151.

In the present invention, a thickness of the amorphous binder 152 at a location nearer the outer peripheral face of the exhaust pipe than a location of the crystalline inorganic materials 151 is defined as described below.

The thickness is defined as a distance between the surface of the surface-coating layer and the outermost periphery of each crystalline inorganic material 151 (a crystalline inorganic material with no other crystalline inorganic materials residing on the outer side than it does, in the thickness direction of the surface-coating layer) residing at the outermost location in the thickness direction of the surface-coating layer as shown in FIG. 2(*b*); that is, it is defined as a distance shown by each arrow in FIG. 2(*b*).

The thickness of the amorphous binder at a location nearer the outer peripheral face of the exhaust pipe than a location of the crystalline inorganic materials is measured as follows.

First, the exhaust pipe is cut in its longitudinal direction and in a direction perpendicular to the longitudinal direction so as to obtain an observation image of the cut portion. Thereafter, an average distance between the surface of the surface-coating layer and the outermost peripheries of the respective crystalline inorganic materials residing at the outermost locations in the thickness direction of the surface-coating layer is measured.

In the surface-coating layer 15 formed on the outer peripheral face of the base 14, a plurality of the crystalline inorganic materials 151 are distributed in an accumulative manner in the thickness direction (the vertical direction in FIGS. 2(*a*) and 2(*b*)) of the surface-coating layer 15.

In the present invention, the statement "the plurality of the crystalline inorganic materials 151 being distributed in an accumulative manner in the thickness direction of the surface-coating layer 15" means that a portion exists in which the plurality of crystalline inorganic materials overlap with one another when the surface-coating layer is observed from the outer periphery side of the exhaust pipe toward the base side in the thickness direction of the surface-coating layer.

The material of the crystalline inorganic material is not particularly limited. An oxide of a transition metal is desirably used, and specific examples thereof include manganese dioxide, manganese oxide, iron oxide, cobalt oxide, copper oxide, chrome oxide and nickel oxide. Each of these may be used alone or two or more kinds of these may be used in combination.

These oxides of transition metals are suitably used for producing crystalline inorganic materials having high infrared emissivity.

Examples of the amorphous binder include barium glass, boron glass, strontium glass, alumino-silicate glass, soda-zinc glass and soda barium glass. Each of these may be used alone or two or more kinds of these may be used in combination.

Such an amorphous binder is a low-melting-point glass and its softening temperature is in the range of 400 to 1100° C. Accordingly, melting the amorphous inorganic binder to coat the outer peripheral face of the base and then firing and heating the base make it possible to easily form a robust surface-coating layer on the outer peripheral face of the base.

When the amorphous binder is a low-melting-point glass, the melting point thereof is desirably in the range of 400 to 1100° C.

When the low-melting-point glass has a melting point of less than 400° C., there is a case where the glass easily softens during use and extraneous matters adhere to the glass. On the other hand, when the melting point exceeds 1100° C., there is a case where the heating in formation of a surface-coating layer deteriorates the base.

It is desirable that the amorphous binder have an infrared radiation transmittance of 0.25 or higher at a wavelength of 2 to 8 μm.

This is because the amorphous binder having the above infrared radiation transmittance at a wavelength of 2 to 8 μm makes it easier for infrared radiation to be emitted outward and thereby makes the exhaust pipe have a better heat-releasing property.

In the surface-coating layer containing crystalline inorganic materials and an amorphous binder, a coefficient of thermal expansion of the crystalline inorganic materials containing the oxide of a transition metal is low as 8 to $9\times10^{-6}$/° C. and a coefficient of thermal expansion of the amorphous binder containing the low-melting-point glass is high as 8 to $25\times10^{-6}$/° C. Therefore, a coefficient of thermal expansion of the surface-coating layer can be controlled by adjusting a compounding ratio of the crystalline inorganic materials and the amorphous binder. On the other hand, a base containing a metal, for example, a base containing stainless steel, has a coefficient of thermal expansion of 10 to $18\times10^{-6}$/° C.

By adjusting the compounding ratio of the crystalline inorganic materials and the amorphous binder, it is possible to make the coefficient of thermal expansion of the surface-coating layer close to the coefficient of thermal expansion of the base. When a difference in the coefficients of thermal expansion between the two is small, the surface-coating layer and the base are allowed to have excellent adhesion strength.

The difference in the coefficients of thermal expansion between the surface-coating layer and the base is desirably $10\times10^{-6}$/° C. or less. When the difference in the coefficients of thermal expansion between the two is in the above range, a peeling between the two, and a deformation and damage in the surface-coating layer and the base are particularly not likely to occur, even when high-temperature exhaust gases flow through the exhaust pipe.

In the surface-coating layer containing the crystalline inorganic materials and the amorphous binder, with respect to a compounding amount of the crystalline inorganic materials, a desirable lower limit is 10% by weight and a desirable upper limit is 90% by weight.

When the compounding amount of the crystalline inorganic materials is less than 10% by weight, there is a case where the infrared emissivity is insufficient and the heat-releasing property in a high-temperature region is inferior. On the other hand, when the compounding ratio exceeds 90% by weight, there is a case where the adhesion between the heat-releasing layer and the base is lowered.

With respect to the compounding amount of the crystalline inorganic materials, a more preferable lower limit is 30% by weight and a more preferable upper limit is 70% by weight.

When the compounding amount is less than 10% by weight, there is a case where the plurality of the crystalline inorganic materials are not accumulated in the thickness direction of the surface-coating layer.

In the exhaust manifold 11, a thermal conductivity of the surface-coating layer at 100 to 200° C. is desirably lower than a thermal conductivity of the base at 100 to 200° C.

The reason for this is presumably as follows. Namely, when the base is heated by exhaust gases flowing into the exhaust manifold 11, while a thermal conduction rate in the base is high, a thermal conduction rate from the base to the outside through the heat-releasing layer is low. Therefore, in a low-temperature region (around less than 500° C. in the present description) in which thermal conduction contributes to a heat transfer very much, the surface-coating layer is allowed to have excellent heat insulating properties. When the surface-coating layer has excellent heat insulating properties in the low-temperature region as described above, the surface-coating layer is presumably capable of raising the temperature of exhaust gases to a predetermined temperature (e.g. activation temperature of a catalyst for converting exhaust gases) in a short time after starting a vehicle engine and the like.

A value of the thermal conductivity of the surface-coating layer at 100 to 200° C. is desirably 0.1 to 4 W/mK.

The thermal conductivity of the surface-coating layer at room temperature can be measured by using a known method such as a hot-wire method and a laser flash method.

It is desirable that the surface-coating layer have a thickness of 0.5 to 10 μm.

When the surface-coating layer has a thickness of less than 0.5 μm, a sufficient heat-releasing property might not be ensured. On the other hand, when the surface-coating layer has a thickness exceeding 10 μm, cracks might appear on the surface-coating layer or the exhaust manifold might be deformed.

Lightness of the outer peripheral face of the surface-coating layer, which is defined in JIS Z 8721, is desirably N4 or less.

When the lightness is N4 or less, an emissivity in the visible region is also excellent.

Here, the lightness N is determined such that the lightness of ideal black is 0, and that the lightness of ideal white is 10. The lightness is equally divided stepwise into 10 degrees from the lightness of the black to the lightness of the white, based on the lightness perception. The degrees of the lightness are represented as codes of N0 to N10 and the codes are applied for each color. The actual measurement is performed by comparing the color of the outer peripheral face with a color chart having the lightness corresponding to N0 to N10. In this case, 0 or 5 is taken as a figure in the first decimal place.

It is desirable that the surface-coating layer is formed on the entire outer peripheral face of the base because, in this case, the area of the surface-coating layer will be largest and the surface-coating layer will have a particularly excellent heat-releasing property. However, a surface-coating layer may be formed only on a part of the outer peripheral face of the base. The surface-coating layer may not be formed on the portions that are to be welded and the portions in which threaded holes are to be formed when the exhaust pipe is attached, or the portions that another component is to contact or slide on after attachment; this is because a surface-coating layer formed on those portions particularly tends to peel off.

When a surface-coating layer is formed only on a part of the outer peripheral face of the base, an area of the part on which the surface-coating layer is formed is desirably 50% or more of the entire outer peripheral face of the base.

When the area of the part on which the surface-coating layer is formed is less than 50%, there is a case where a heat-releasing property of the exhaust manifold 11 is insufficient and a rise in temperature of the exhaust manifold 11 cannot be controlled adequately.

When a surface-coating layer is formed on a part of the outer peripheral face of the base, an area having the surface-coating layer formed thereon is not particularly limited. A surface-coating layer may be formed in a solid manner on a single or a plurality of places selected from the entire outer peripheral face of the base, or alternatively, a surface-coating layer may be formed on the entire outer peripheral face of the base so as to produce a regular pattern of mesh or an irregular pattern.

Further, through holes (pinholes) penetrating the surface-coating layer at equal intervals or at random may be formed in the surface-coating layer formed on the entire outer peripheral face of the base.

The maximum height Rz of the inner face of the base is desirably 0.1 μm or more.

This is because heat of exhaust gases is easily conducted to the base.

Thus far, the exhaust pipe of the present invention has been described taking as an example an exhaust manifold. The exhaust pipe of the present invention can be suitably used as a pipe for forming the catalyst converter 12 shown in FIG. 1(*a*), a turbine housing or the like.

In the following explanation of the present invention, the portion of an exhaust pipe including a base and a surface-coating layer, thus far described, is referred to as an exhaust pipe body.

In addition to an exhaust pipe body including a base and a surface-coating layer, an exhaust pipe of the present invention may be equipped with a heat-receiving member provided over the outer peripheral face of the exhaust pipe body. The heat-receiving member has a lower temperature compared to the exhaust pipe body when exhaust gases flow through the exhaust pipe body.

By providing a heat-receiving member whose temperature is lower than that of an exhaust pipe body, it is possible to control a rise in temperature especially when high-temperature exhaust gases flow into the exhaust pipe.

More specifically, when the exhaust pipe body is an exhaust manifold, a so-called heat insulator, as a heat-receiving member, is desirably provided over the surface-coating layer.

The heat insulator is described with reference to the drawing.

FIG. 3 is an exploded perspective view schematically showing a vehicle engine, and an exhaust pipe of the present invention connected to the vehicle engine.

In FIG. 3, "10" indicates an engine and a cylinder head 17 is mounted on a top of a cylinder block 16 of the vehicle engine 10. Further, an exhaust manifold 11 as an exhaust pipe body is attached on one side face of the cylinder head 17.

The exhaust manifold 11 has a function of gathering exhaust gases from respective cylinders and transferring the exhaust gases to a not-shown catalyst converter and the like. Part of the outer peripheral face of the exhaust manifold 11 is covered with a heat insulator 18. The heat insulator 18 is arranged over the outer peripheral face of the exhaust manifold 11 with a predetermined space therebetween.

When the heat-receiving member is arranged over the outer peripheral face of the exhaust pipe body, it is desirable that a coverage ratio of the heat-receiving member to the outer peripheral face of the exhaust pipe body be 30 to 100%. When the coverage ratio of the heat-receiving member is less than 30%, the heat-receiving member might not be able to sufficiently receive radiation heat released from the exhaust pipe and thus the exhaust pipe might not be cooled sufficiently.

In the following, the calculation method of the coverage ratio in the present invention is described with reference to the drawing.

FIG. 4 is a cross-sectional view for explaining the calculation method of the coverage ratio of the heat-receiving member.

In the calculation for the coverage ratio, first, in a cross section of the exhaust pipe having the heat-receiving member, the area of an exhaust pipe body 111 covered by a covering member 118 is calculated. Specifically, an angle θ is calculated which is an angle of the part where the covering member 118 exists when seen from the point "c" which is the center of the exhaust pipe body 111. The proportion of this angle θ to 360° is the coverage ratio in the cross section shown in FIG. 4. In the cross section shown in FIG. 4, since the angle θ is 90°, the coverage ratio in the cross section is 25%. Thereafter, the coverage ratio of the cross section of the exhaust pipe calculated as described above is integrated in the longitudinal direction of the exhaust pipe so that the coverage ratio of the heat-receiving member in the exhaust pipe is calculated.

When the entire peripheral face of the exhaust pipe is covered by the heat-receiving member, the coverage ratio is 100%.

When the heat-receiving member is placed over the outer peripheral face of the exhaust pipe body, an area of the heat-receiving member over the outer peripheral face of the exhaust pipe body is desirably 0.3 to 10 times as large as an area of the outer peripheral face of the exhaust pipe body.

When the area of the heat-receiving member is less than 0.3 times, there is a case where the heat-receiving member cannot receive radiation heat released from the exhaust pipe sufficiently and fails to cool the exhaust pipe satisfactorily. When the area of the heat-receiving member is more than 10 times, there is a case where the heat-receiving member is enlarged and the shape of the heat-receiving member is complicated (corrugated cross section and the like).

The heat-receiving member such as a heat insulator desirably has a surface-coating layer similar to the surface-coating layer included in the exhaust pipe body, on the face which is placed over the exhaust pipe body.

By forming a surface-coating layer not only on the outer peripheral face of the base but also on the face of the retaining member which is placed over the exhaust pipe body, a heat-releasing property of the exhaust pipe body is improved.

The reason for this is presumably as follows.

Namely, in addition to receiving heat radiated from the exhaust pipe, the heat-receiving member radiates the heat; therefore, a heat transfer in the whole of the exhaust pipe is ensured.

Further, when the heat-receiving member is a plate-like body such as a flat plate, a curved plate and a flexed plate, a surface-coating layer may be formed not only on the face of the heat-receiving member, which is placed over the exhaust pipe body, but also on the reverse face of the above face. In some cases, a surface-coating layer of the heat-receiving member may be formed only on the reverse face of the face which is placed over the exhaust pipe body.

When a surface-coating layer is to be formed on the heat-receiving member, a composition of the surface-coating layer included in the exhaust pipe body and a composition of the surface-coating layer to be formed on the heat-receiving member may be completely the same or different.

In the heat-receiving member, the surface-coating layer may be formed on a surface of a base member which contains a metal same as the metal in the base included in the exhaust pipe body, a resin such as FRP or the like.

When the surface-coating layer is formed on the heat-receiving member, a thickness ratio of the surface-coating layer formed on the heat-receiving member to the surface-coating layer included in the exhaust pipe body is desirably 0.7 to 10.

When the thickness ratio is less than 0.7, there is a case where the heat-receiving member cannot receive heat radiated from the exhaust pipe sufficiently. On the other hand, when the thickness ratio exceeds 10, there is a case where the heat-receiving member is deformed.

There has been described a configuration of an exhaust pipe equipped with a heat-receiving member taking as an example a case where the exhaust pipe body is an exhaust manifold and the heat-receiving member is a heat insulator. However, the heat-receiving member is not limited to a heat insulator and another component of a vehicle may function as the heat-receiving member.

The exhaust pipe of the present invention may be equipped with the heat-receiving member even in a case where the exhaust pipe is a pipe included in a catalyst converter, a turbine housing or the like.

An exhaust pipe body included in the exhaust pipe of the present invention is not limited to a single pipe as shown in FIGS. 1(*a*) and 1(*b*) and may be a double pipe.

FIG. 5 is a cross-sectional view schematically showing another example of the exhaust pipe of the present invention.

An exhaust pipe 21 shown in FIG. 5 has a double-pipe structure including an inner pipe 21*a* and an outer pipe 21*b*. The inner pipe 21*a* and the outer pipe 21*b* are joined at a plurality of sites by spot welding (not shown) or the like, so as to be combined in a state where they maintain a certain distance therebetween.

The inner pipe 21*a* has a base 24*a* containing a metal and having a cylindrical shape, and a surface-coating layer 25*a* formed on the outer peripheral face of the base 24*a*. The outer pipe 21*b* has a base 24*b* containing a metal and having a cylindrical shape, and a surface-coating layer 25*b* formed on the outer peripheral face of the base 24*b*.

The exhaust pipe of the present invention may have such a double-pipe structure. By having such a double-pipe structure, the exhaust pipe can exert the following effects.

Namely, when a temperature of the exhaust pipe is in a low-temperature region, for example, immediately after starting a vehicle engine, the exhaust pipe has a superior heat insulating property, so that the exhaust-gas temperature can be maintained at a catalyst activation temperature in a short time. On the other hand, when exhaust gases become very hot, radiation highly contributes to the heat release, so that an excessive rise of the exhaust-gas temperature can be prevented without depending on heat transfer by conduction.

In the outer pipe 21*b* included in the exhaust pipe 21, the surface-coating layer 25*b* is formed on the outer peripheral face of the base 24*b*. However, an outer pipe included in an exhaust pipe having a double-pipe structure is not necessarily required to have a surface-coating layer formed on the outer peripheral faces thereof. In the outer pipe 21*b*, a surface-coating layer may be formed only on the inner face of the base, or alternatively, a surface-coating layer may be each formed on the inner face and the outer peripheral face of the base.

The exhaust pipe of the present invention is desirably used against exhaust gases having a temperature of 400 to 1000° C.

Exhaust gases having such temperatures are suitably used for achieving the above-described effects.

Next, a method for producing an exhaust pipe of the present invention is described in accordance with a process sequence.

In the following, the method for producing an exhaust pipe is described taking as an example a case of producing an exhaust pipe having a surface-coating layer that contains crystalline inorganic materials and an amorphous binder and is formed on the outer peripheral face of a base containing a metal (a metal base).

(1) Using a cylindrical metal base processed into a predetermined shape as a starting material, cleaning is performed so as to remove impurities on a surface of the metal base.

The cleaning is not particularly limited, and conventionally known cleaning may be used. More specifically, ultrasonic cleaning in alcohol solvent, and the like may be used.

Further, after the cleaning, roughening may be optionally performed on the surface of the base in order to enlarge a specific surface area of the outer peripheral face of the base or to adjust the maximum height Rz of the inner face of the base.

More specifically, roughening such as sandblasting, etching and high-temperature oxidation may be performed. Each of the roughening may be used alone or two or more kinds of these may be used in combination.

(2) Separately, a crystalline inorganic material and an amorphous binder are wet-mixed so as to prepare a raw material composition for a surface-coating layer.

More specifically, a powder of a crystalline inorganic material and a powder of an amorphous binder are prepared so that each has a predetermined particle size and a predetermined shape. Respective powders are dry-mixed at a predetermined compounding ratio to obtain a mixed powder. Then, water is added thereto and the mixture is wet-mixed by ball milling so as to prepare a raw material composition for a surface-coating layer.

The compounding ratio of the mixed powder and water is not particularly limited. However, around 100 parts by weight of water with respect to 100 parts by weight of mixed powder is desirable. The reason for this is that a viscosity suitable for applying to the metal base can be obtained. According to need, an inorganic fiber or an organic solvent may be blended to the raw material composition for a surface-coating layer.

When a surface-coating layer having pores formed therein is to be formed, at least one of a foaming agent, a hollow filler and an inorganic fiber is to be blended into the raw material composition for a surface-coating layer.

(3) The outer peripheral face of the metal base is coated with the raw material composition for a surface-coating layer.

As a method for coating with the raw material composition for a surface-coating layer, for example, spray coating; electrostatic coating; ink jet; transfer using a stamp, a roller or the like; brush coating and the like may be used.

In addition, the metal base may be immersed in the raw material composition for a surface-coating layer so as to be coated with the raw material composition for a surface-coating layer.

Further, in preparation of the raw material composition for a surface-coating layer, the raw material composition for a surface-coating layer may be prepared as a composition for electrodeposition. Then, the metal base may be immersed in the composition for electrodeposition and the outer peripheral face of the metal base may be coated with the raw material composition for a surface-coating layer by electrodeposition.

In this case, it is necessary to blend an additive for zeta potential control and for adjustment of a resistance value of the solvent, and a stabilizer for securing dispersibility of a crystalline inorganic material and an amorphous binder, with the raw material composition for a surface-coating layer.

More specifically, the composition for electrodeposition may be prepared, for example, by adding a mixture of acetone and iodine to a raw material composition for a surface-coating layer.

In order to form a coat layer by electrodeposition, a steel wire functioning as a positive electrode and a metal base are placed in a solution which is prepared by adding acetone and iodine to the raw material composition for a surface-coating layer. Further, an electric voltage is applied to make the metal base function as a negative electrode.

Further, a solution prepared by dispersing the raw material composition for a surface-coating layer in water and adding an organic solvent may be used as the composition for electrodeposition.

Aerosol deposition method (AD) may also be used as a method for coating the outer peripheral face of the metal base with the raw material composition for a surface-coating layer.

In this case, at the time of preparation of a raw material composition for a surface-coating layer, it is desirable to prepare a raw material composition for a surface-coating layer in a form of particles having a particle diameter of 1 μm or less. The reason for this is that activity of the raw material composition for a surface-coating layer is improved.

In the case of using the AD, particles of a raw material composition for a surface-coating layer collide with a metal base in vacuum and thus a coat layer is to be formed.

At least one of plating such as nickel plating and chrome plating, oxidation of the outer peripheral face of the metal base, and the like may be performed before the coating of the outer peripheral face of a metal base with a raw material composition for a surface-coating layer.

The reason for this is that there is a case where an adhesion property between a metal base and a surface-coating layer is improved.

(4) The metal base coated with the raw material composition for a surface-coating layer is fired.

More specifically, after the metal base coated with the raw material composition for a surface-coating layer is dried, a surface-coating layer is formed by firing.

The firing temperature is desirably set to the melting point of the amorphous binder or higher, and it is desirably 700 to 1100° C. The firing temperature depends on the kind of the blended amorphous binder. By setting the firing temperature to the melting point of the amorphous binder or higher, the metal base and the amorphous binder can be adhered solidly, so that a surface-coating layer solidly adhered to the base can be formed.

Forming a surface-coating layer by the above methods (2) to (4) usually allows the plurality of crystalline inorganic materials to be distributed in an accumulative manner in the thickness direction of the surface-coating layer.

The following methods or the like can be used to control the average thickness of the amorphous binder at a location nearer the outer peripheral face of the exhaust pipe than a location of the crystalline inorganic materials.

For example, controlling the firing conditions in the above (4) enables controlling of the average thickness of the amorphous binder at a location nearer the outer peripheral face of the exhaust pipe than a location of the crystalline inorganic materials. More specifically, lengthening the heating time or increasing the heating temperature can make the amorphous binder have a reduced average thickness at a location nearer the outer peripheral face of the exhaust pipe than a location of the crystalline inorganic materials. This is because the amount of the amorphous binder decreases due to a reaction between the amorphous binder and the base or due to vaporization of the amorphous binder.

Alternatively, for example, controlling the compounding amounts of the crystalline inorganic materials and amorphous binder at the time of preparation of the raw material composition for a surface-coating layer also enables controlling of the average thickness of the amorphous binder at a location nearer the outer peripheral face of the exhaust pipe than a location of the crystalline inorganic materials.

As yet another example, the average thickness of the amorphous binder can be controlled by sufficiently increasing the compounding amount of the crystalline inorganic materials at the time of preparation of the raw material composition for a surface-coating layer so as to form a heat-releasing layer with the crystalline inorganic materials exposed on the surface thereof, and then coating the heat-releasing layer with only the amorphous binder.

EXAMPLES

In the following, the present invention is more specifically described by using examples. However, the present invention is not limited only to these examples.

First, exhaust pipe bodies were produced by the methods in Examples 1 to 5 and Comparative Examples 1 and 2. Then, a heat-receiving member was disposed over each of the exhaust pipe bodies, and their performance as an exhaust pipe was evaluated.

Example 1

(1) A cylindrical (cross sectional shape is substantially perfect circle) metal base having a diameter (external diameter) of 40 mm, a thickness of 2 mm, and a length of 300 mm was used as a starting material. The metal base was made of SUS430 and had the following properties: thermal conductivity at 100 to 200° C.: 25 W/mK; emissivity at a wavelength of 1 to 15 μm at 600° C.: 0.30; and coefficient of thermal expansion in a temperature range of room temperature to 500° C.: $10.4\times10^{-6}$/° C. First, this metal base was ultrasonically cleaned in an alcohol solvent, and then sandblasted to make the outer peripheral face of the metal base into a rough face having the maximum height Rz of 2.5 μm. The sandblasting was performed for 10 minutes using $Al_2O_3$ abrasive grains of #80.

(2) Separately, 30% by weight of a $MnO_2$ powder, 5% by weight of a FeO powder and 5% by weight of a CuO powder as crystalline inorganic materials, and 60% by weight of a BaO—$SiO_2$ glass powder as an amorphous binder were dry-mixed to prepare a mixed powder. Then, 100 parts by weight of water were added to 100 parts by weight of the mixed powder and they were wet-mixed by ball milling to prepare slurry.

(3) The sandblasted face of the metal base was coated with the slurry prepared in the above (2) by spray coating.

Then, the metal base having a slurry-coated layer formed by spray coating was dried at 100° C. for two hours and fired at 900° C. in air for 20 minutes, so that a surface-coating layer (thermal conductivity at 100 to 200° C.: 2.6 W/mK, coefficient of thermal expansion measured in a range of a room temperature to 500° C.: $9.6\times10^{-6}$/° C.) was formed on the outer peripheral face of the metal base. Thereby, an exhaust pipe body was produced.

The slurry-coated layer was formed so that the surface-coating layer after the firing has a thickness of 4.9 μm.

In the surface-coating layer formed by firing under the conditions above, the amorphous binder had an average thickness of 0.1 μm at a location nearer the outer peripheral face of the exhaust pipe body than a location of the crystalline inorganic materials.

The average thickness of the amorphous binder at a location nearer the outer peripheral face of the exhaust pipe body than a location of the crystalline inorganic materials was measured by the following method.

That is, the exhaust pipe body was cut in both its longitudinal direction and the direction perpendicular to the longitudinal direction so that observation images of the cut faces thereof would be obtained. Here, images of two positions each on the face cut along the longitudinal direction and on the face cut along the direction perpendicular to the longitudinal direction were obtained as the observation images. Thereafter, each observation image was used to measure the average distance between the surface of the surface-coating layer and the outermost peripheries of the respective crystalline inorganic materials residing at the outermost location in the thickness direction of the surface-coating layer. The width of the measured region was 100 μm.

The thermal conductivity and/or the coefficient of thermal expansion of the surface-coating layer were/was measured by using the following method.

Namely, a crystalline inorganic material and an amorphous binder, which have identical compositions with the surface-coating layer, were ground and mixed. The mixture was heated to a temperature higher than the melting point of the amorphous binder and kneaded in a state where the amorphous binder was molten. The obtained material was cooled and solidified to produce a solid material. Then, the thermal conductivity of the solid material was measured by a quick thermal conductivity meter (produced by Kyoto Electronics Manufacturing Co., Ltd.: QTM-500) and the coefficient of thermal expansion of the solid material was measured by TMA (Thermomechanical Analysis) device (produced by Rigaku Corporation: TMA 8310).

Examples 2 to 5

Each exhaust pipe body was produced in the same way as in Example 1 except that the average thickness of the amorphous binder at a location nearer the outer peripheral face of the exhaust pipe body than a location of crystalline inorganic materials was set to the thickness shown in Table 1.

The average thickness was adjusted by controlling the firing temperature.

That is, the firing temperature was changed to 850° C. in Example 2, 820° C. in Example 3, 800° C. in Example 4, and 780° C. in Example 5.

Comparative Example 1

An exhaust pipe body was produced in the same way as in Example 1 except that the average thickness of the amorphous binder at a location nearer the outer peripheral face of the exhaust pipe body than a location of crystalline inorganic materials was set to the thickness shown in Table 1 by changing the firing temperature to 730° C.

Comparative Example 2

An exhaust pipe body was produced in the same way as in Example 1 except that the method of preparing slurry in the above (2) of Example 1 was changed to the following method.

That is, 75% by weight of a $MnO_2$ powder, 12.5% by weight of a FeO powder and 12.5% by weight of a CuO powder as crystalline inorganic materials were dry-mixed to prepare a mixed powder. Then, 100 parts by weight of water was added to 100 parts by weight of the mixed powder and they were wet-mixed by ball milling to prepare slurry.

Therefore, the exhaust pipe body of the present comparative example had the surface-coating layer with the crystalline inorganic materials exposed on the outer peripheral face thereof.

TABLE 1

| | Exhaust pipe body | |
|---|---|---|
| | Average thickness of amorphous inorganic material at location nearest to the surface (μm) | Emissivity of surface-coating layer |
| Example 1 | 0.1 | 0.98 |
| Example 2 | 1.0 | 0.89 |
| Example 3 | 5.1 | 0.87 |
| Example 4 | 15.2 | 0.80 |
| Example 5 | 20.0 | 0.78 |
| Comparative Example 1 | 24.8 | 0.50 |
| Comparative Example 2 | — | 0.99 |

Next, a heat-receiving member was arranged around each of the exhaust pipe bodies produced in Examples 1 to 5 and Comparative Examples 1 and 2 to obtain exhaust pipes 1 to 12, and their characteristics were evaluated. The exhaust pipe 11 was evaluated as an exhaust pipe without a heat-receiving layer provided. Table 2 shows the structures of the heat-receiving members and the evaluation results.

The heat-receiving members were each produced in the following method.

First, a steel plate with a thickness of 0.6 mm was prepared and a surface-coating layer was formed on one side of this steel plate in the same method as in the above (2) and (3) of Example 1. Next, the steel plate with the surface-coating layer formed thereon was processed into a predetermined size, and then processed into a predetermined shape.

More specifically, the heat-receiving members with a coverage ratio of 100% in the exhaust pipes 1 to 5, 9 and 10 were each produced by processing into a cylindrical shape a steel plate (13.8 mm×300 mm) with a surface-coating layer formed on one surface thereof.

The heat-receiving member with a coverage ratio of 100% in the exhaust pipe 6 was produced by processing into a cylindrical shape a steel plate (62.8 mm×300 mm) with a surface-coating layer formed on one surface thereof.

The heat-receiving member of the exhaust pipe 7 was produced by processing a steel plate (13.8 mm×300 mm) with a surface-coating layer formed on one surface thereof so that its cross-sectional shape would be a circular arc with a central angle of 342°.

The heat-receiving member of the exhaust pipe 8 was produced by processing a steel plate (18.8 mm×300 mm) with a surface-coating layer formed on one surface thereof so that its cross-sectional shape would be a circular arc with a central angle of 108°.

The heat-receiving member of the exhaust pipe 12 was produced by processing a steel plate (2.5 mm×300 mm) with a surface-coating layer formed on one surface thereof so that its cross-sectional shape would be a circular arc with a central angle of 36°.

Each exhaust pipe was evaluated in the following method.

FIG. 6(*a*) is a schematic view for explaining an evaluation method of a heat-releasing property of an exhaust pipe. FIG. 6(*b*) is a D-D line cross-sectional view of FIG. 6(*a*).

As shown in FIGS. 6(*a*) and 6(*b*), an exhaust pipe 34 having an exhaust pipe body 32 and a heat-receiving member 33 therein was connected to a combustion gas generator 30 for measurement.

That is, the inlet side of the exhaust pipe 34 was connected to the combustion gas generator 30 through a gas inlet tube 31 and the outlet side of the exhaust pipe 34 was connected to a gas outlet tube 35 inside which a thermocouple (not illustrated) was provided. Next, 10 L/min of natural gas was burnt in the combustion gas generator 30 while being supplied with 40 L/min of oxygen. The combustion gases generated from the burning were introduced into the exhaust pipe 34 and the temperature of the combustion gases coming out from the outlet side of the exhaust pipe 34 was measured by the thermocouple. Then, the temperature difference of the combustion gas between the inlet side and outlet side of the exhaust pipe 34 was calculated. Table 2 shows the calculation results. In the present evaluation, combustion gases of 950° C. were introduced into the exhaust pipe 34.

In the present evaluation, an exhaust pipe achieving a temperature difference of 210° C. or more is considered to be an exhaust pipe that can be used suitably.

It is apparent from the results in Table 2 that the exhaust pipes 1 to 5 provided with the respective exhaust pipe bodies of Examples 1 to 5 have a better heat-releasing property than that of the exhaust pipe 9 provided with the exhaust pipe body of Comparative Example 1.

Therefore, it has become evident that the heat-releasing property of an exhaust pipe is made excellent by setting the average thickness of the amorphous binder to 20 μm or less at a location nearer the outer peripheral face of an exhaust pipe body than a location of the crystalline inorganic materials in the surface-coating layer forming the exhaust pipe body. This is because the infrared emissivity of the surface-coating layer greatly decreases when the amorphous binder has an average thickness exceeding 20 μm at a location nearer the outer peripheral face of the exhaust pipe body than a location of the crystalline inorganic materials, as shown in Table 1.

The exhaust pipe 10 was provided with the exhaust pipe body of Comparative Example 2 which had the surface-coating layer with no amorphous binder blended therein and with the crystalline inorganic materials exposed thereon. Although the exhaust pipe 10 was similar to the exhaust pipes 1 to 5 in terms of the heat-releasing property, there was a problem in which the surface-coating layer (crystalline inorganic materials) peeled off after the heat-releasing property evaluation test. This is considered to be due to lack of amorphous binder.

It has become evident from comparison between the exhaust pipe 6 and the exhaust pipe 1 that the heat-releasing property tends to be improved as a ratio of the inner face area of the heat-receiving layer to the outer peripheral face area of the exhaust pipe body (area of the inner face of the heat-receiving member/area of the outer peripheral face of the exhaust pipe body) becomes higher.

Further, comparison between the exhaust pipes 1, 7, and 8 and the exhaust pipes 11 and 12 showed that desirable coverage ratio of the heat-receiving member is 30% or more.

This is because lack of the heat-receiving member or the coverage ratio of less than 30% was found to decrease the heat-releasing property.

TABLE 2

Figure 1:
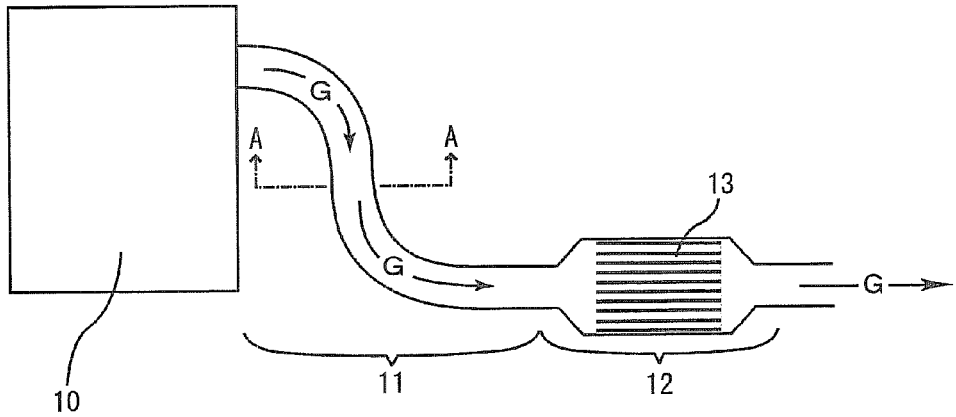
FIG. 1(*a*) is a cross-sectional view schematically showing a vehicle engine and an exhaust system connected thereto.
Figure 1:
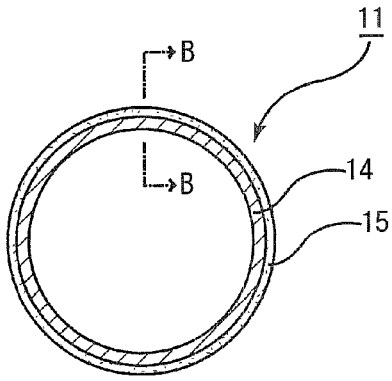

| | | Heat-receiving member | | |
|---|---|---|---|---|
| | Exhaust pipe body | Coverage ratio of the heat-receiving member (%) | (Inner face area of heat-receiving member)/(outer peripheral face area of exhaust pipe body) | Gas temperature difference between inlet side and outlet side (° C.) |
| Exhaust pipe 1 | Example 1 | 100 | 1.1 | 232 |
| Exhaust pipe 2 | Example 2 | 100 | 1.1 | 229 |
| Exhaust pipe 3 | Example 3 | 100 | 1.1 | 221 |
| Exhaust pipe 4 | Example 4 | 100 | 1.1 | 212 |
| Exhaust pipe 5 | Example 5 | 100 | 1.1 | 210 |
| Exhaust pipe 6 | Example 1 | 100 | 5 | 238 |
| Exhaust pipe 7 | Example 1 | 95 | 1.1 | 230 |
| Exhaust pipe 8 | Example 1 | 30 | 1.5 | 220 |
| Exhaust pipe 9 | Comparative Example 1 | 100 | 1.1 | 205 |
| Exhaust pipe 10 | Comparative Example 2 | 100 | 1.1 | 223 |
| Exhaust pipe 11 | Example 1 | — | — | 198 |
| Exhaust pipe 12 | Example 1 | 10 | 0.2 | 202 |

FIG. 1(*b*) is an enlarged A-A line cross-sectional view of FIG. 1(*a*).

Figure 2:
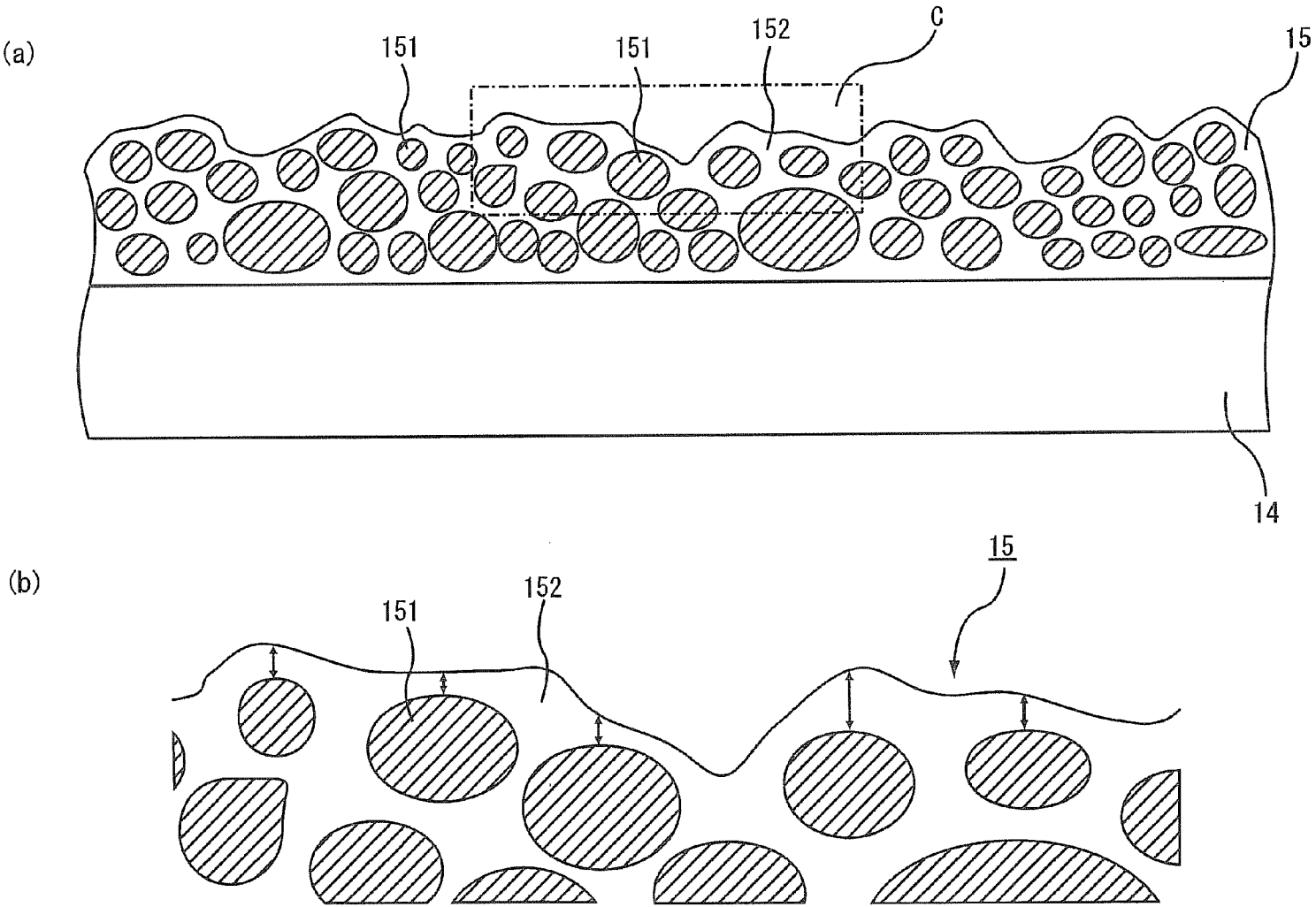

FIG. 2(*a*) is a partially enlarged B-B line cross-sectional view of the exhaust pipe shown in FIG. 1(*b*), and FIG. 2(*b*) is an enlarged view of a region C in FIG. 2(*a*).

Figure 3:
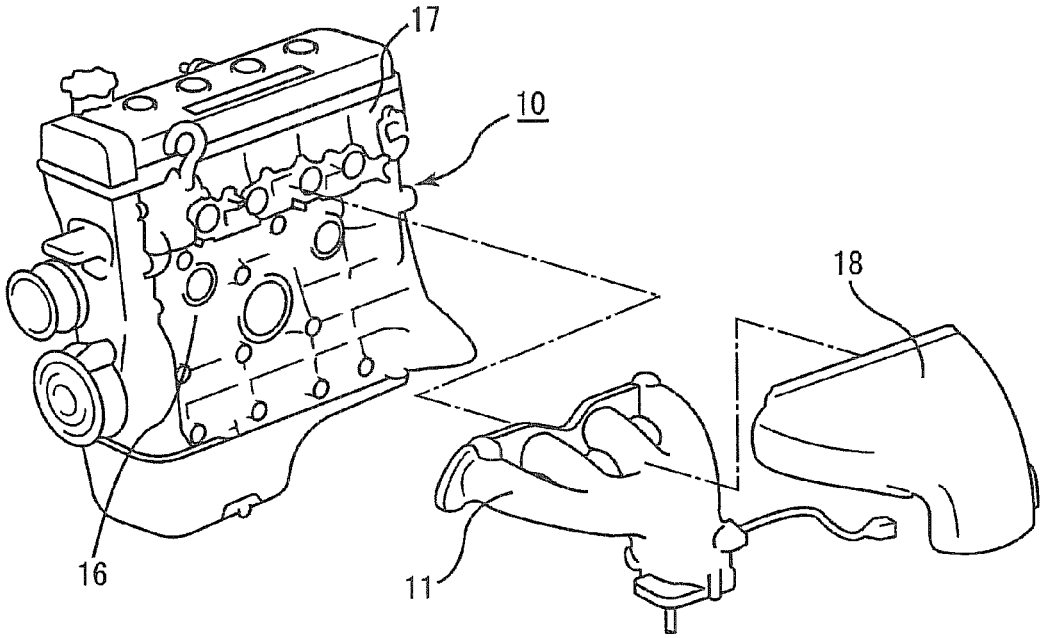

FIG. 3 is an exploded perspective view schematically showing a vehicle engine, and an exhaust pipe of the present invention connected to the vehicle engine.

Figure 4:
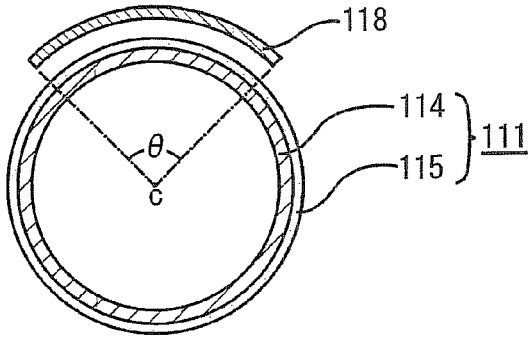

FIG. 4 is a cross-sectional view for explaining a calculation method of a coverage ratio of a heat-receiving member.

Figure 5:
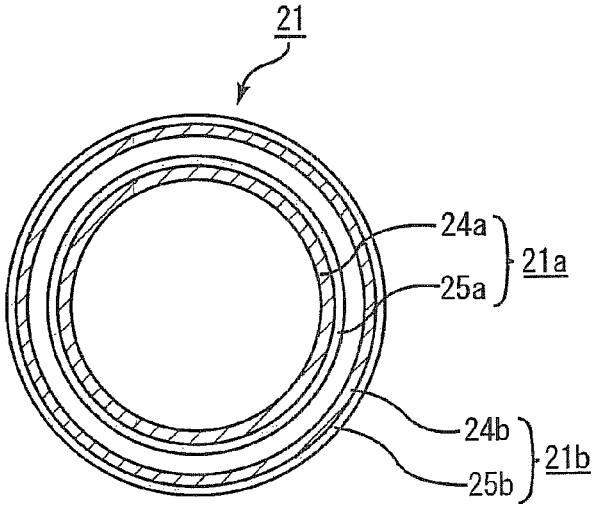

FIG. 5 is a cross-sectional view schematically showing another example of the exhaust pipe of the present invention.

Figure 6:
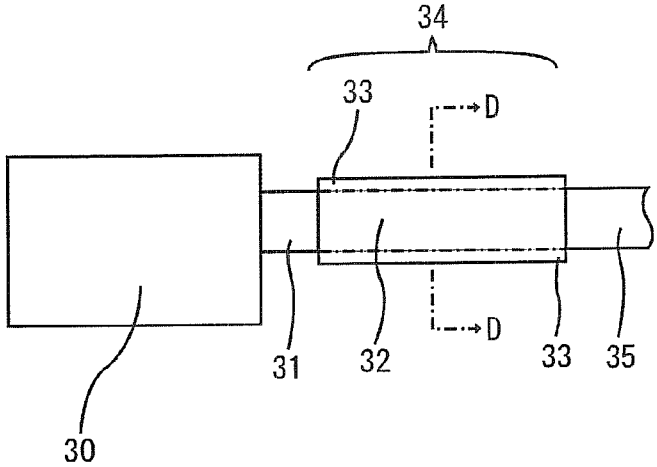
Figure 6:
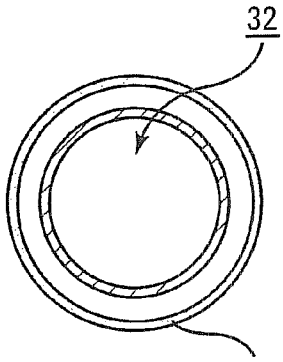

FIG. 6(*a*) is a schematic view for explaining an evaluation method of a heat-releasing property of an exhaust pipe, and FIG. 6(*b*) is a D-D line cross-sectional view of FIG. 6(*a*).

EXPLANATION OF SYMBOLS

21 Exhaust pipe
10 Engine
11 Exhaust manifold
12 Catalyst converter
14, 24*a*, 24*b* Base
15, 25*a*, 25*b* Surface-coating layer
18 Heat insulator

The invention claimed is:

1. An exhaust pipe allowing exhaust gases to flow through the exhaust pipe, the exhaust pipe comprising:

a base that contains metal and has a cylindrical shape; and a surface-coating layer that contains a plurality of crystalline inorganic materials and an amorphous binder and is formed on the outer peripheral face of said base, wherein said plurality of crystalline inorganic materials are distributed in said surface-coating layer, in an accumulative manner in a thickness direction, said amorphous binder has an average thickness of 20 μm or less at a location nearer the outer peripheral face of said exhaust pipe than a location of said crystalline inorganic materials, said crystalline inorganic materials comprise $MnO_2$, FeO, and CuO, and said amorphous binder comprises BaO—$SiO_2$ glass.

2. The exhaust pipe according to claim 1, further comprising:

a heat-receiving member having a surface-coating layer of the same composition as the surface-coating layer included in an exhaust pipe body that includes said base and said surface-coating layer, the surface-coating layer of the heat-receiving member being formed on the face which is placed over the exhaust pipe body.

* * * * *